US005279283A

United States Patent [19]

Dillon

[11] Patent Number: 5,279,283

[45] Date of Patent: Jan. 18, 1994

[54] METHOD FOR PROMOTING CIRCULATION OF BLOOD

[76] Inventor: Richard S. Dillon, 150 Mill Creek Rd., Ardmore, Pa. 19003

[21] Appl. No.: 928,499

[22] Filed: Aug. 11, 1992

[51] Int. Cl.[5] ..... A61H 1/00

[52] U.S. Cl. ..... 128/24 R; 128/40; 128/64; 128/DIG. 20

[58] Field of Search ..... 128/24 R, 64, DIG. 20, 128/40, 703, 707

[56] References Cited

U.S. PATENT DOCUMENTS

| | | | |
|---|---|---|---|
| 3,835,845 | 9/1974 | Maher | 128/64 |
| 3,961,625 | 6/1976 | Dillon | 128/40 |
| 4,077,402 | 3/1978 | Benjamin, Jr. et al. | 128/64 |
| 4,269,175 | 5/1981 | Dillon | 128/24 R |
| 4,343,302 | 8/1982 | Dillon . | |
| 4,590,925 | 5/1986 | Dillon . | |
| 4,753,226 | 6/1988 | Zheng et al. | 128/64 |
| 5,000,164 | 3/1991 | Cooper | 128/64 |

OTHER PUBLICATIONS

Richard S. Dillon, Journal of Clinical Engineering, pp. 63-66, Jan.-Mar., 1980.

Amsterdam et al., Advances in Heart Disease, vol. 1, pp. 1-10, Grune & Stratton, New York, NY (1977).

W. Lawson et al., The American Journal of Cardiology, 70:859-862 (1992).

H. Soroff et al., Critical Care Clinics, 2:277-295 (1986).

A. Solignac et al., Catheterization and Cardiovascular Diagnosis, 3:37-45 (1977).

X. Yu-yun et al., Chinese Medical Journal, 103:768-771 (1990).

Z. Zheng et al., Trans. Am. Soc. Artif. Intern. Organs, 29:599-603 (1983).

*Primary Examiner*—Richard J. Apley
*Assistant Examiner*—Jeanne M. Mollo
*Attorney, Agent, or Firm*—Dann, Dorfman, Herrell and Skillman

[57] ABSTRACT

The present invention provides a method and apparatus for improving the circulation of blood through a patient's heart and extremity. The method comprises applying external positive regional pressure on an extremity synchronously with the patient's heartbeat. An adjustable timing cycle is initiated at the QRS complex of the arterial pulse cycle. The timing cycle is based on an average time period between QRS complexes, which is calculated from a measurement of several successive QRS complexes in the patient's heart rate. Pressure pulses are applied in the end-diastolic portion of the arterial pulse cycle to reinforce the pulse that forces blood into the extremity. The pressure is then relieved prior to the next projected QRS complex to enable the next pulse to enter the extremity without undue obstruction, thereby promoting circulation of blood through the extremity. To promote circulation of blood through the heart, compression of the extremity is released shortly before the next projected QRS complex with a controlled fluid supply.

9 Claims, 1 Drawing Sheet

FIG. 1
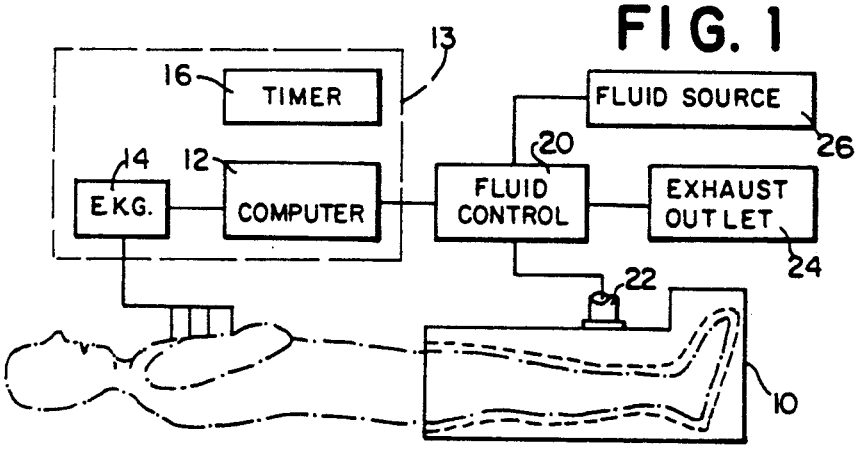
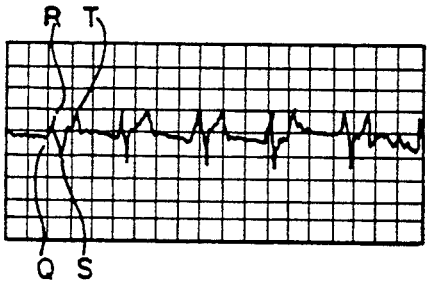
FIG. 2
FIG. 3
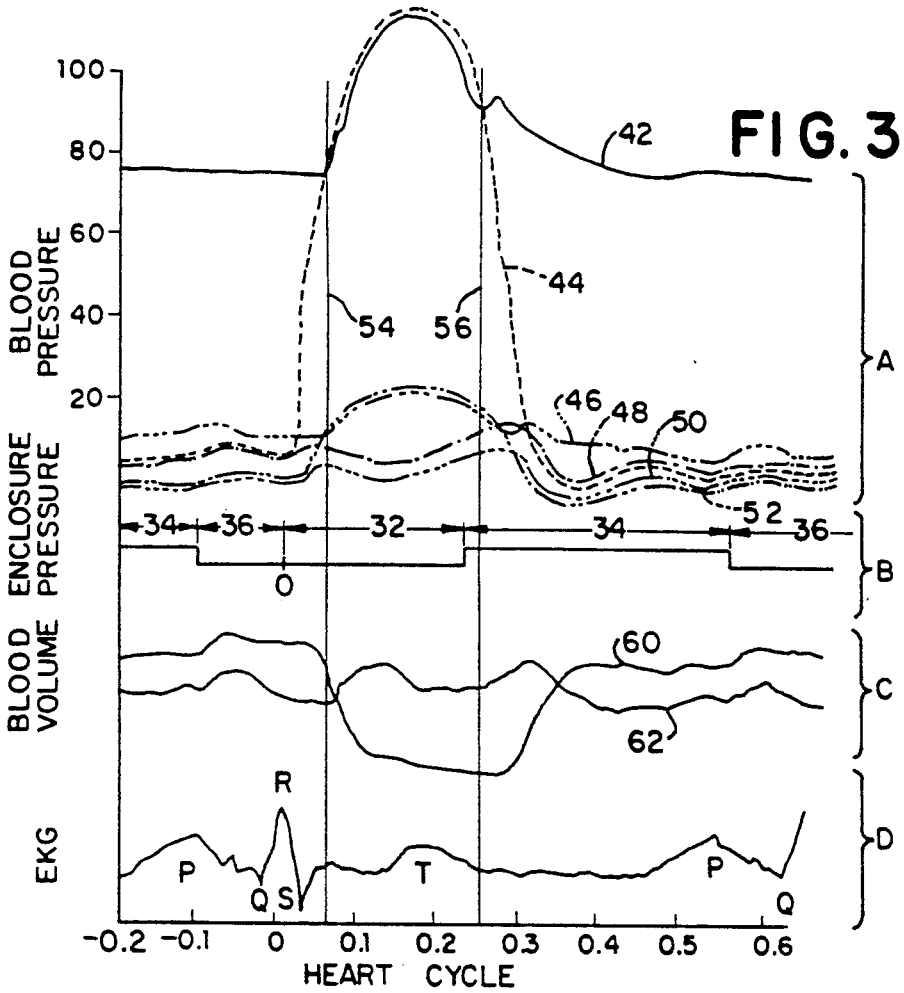

METHOD FOR PROMOTING CIRCULATION OF BLOOD

FIELD OF THE INVENTION

The present invention relates to a method for improving the circulation of blood, and more particularly to a method for improving the circulation of blood through a patient's heart and extremity.

BACKGROUND OF THE INVENTION

For the treatment of various diseases, it is often helpful to enhance the patient's natural blood circulation. It is particularly desirable to promote blood circulation in the treatment of ischemic diseases occurring in the extremities of limbs of the body. By artificially promoting blood circulation, the development of ischemic lesions on a patient's extremities may be curtailed and ischemic lesions that have already developed may be healed. Artificial promotion of blood circulation may also be used in the treatment of coronary heart disease, where it can be utilized to reduce myocardial ischemia and support left ventricle function, thereby increasing coronary artery perfusion and myocardial oxygen supply while reducing cardiac oxygen demand and work.

A non-invasive means of enhancing a patient's natural blood flow involves the use of devices which apply and remove pressure from at least a portion of the patient's extremity. For example, a patient's legs may be enclosed in air bags which may be inflated to apply pressure on the leg and deflated to remove pressure from the leg. Synchronous application of pressure on an extremity can enhance the flow of blood into the extremity, as well as enhancing the pumping of blood through the heart.

Intermittent compression of an extremity can improve the circulation in several ways. First, it facilitates return of interstitial fluid, i.e., lymph fluid or edema, from the extremities. Second, it facilitates venous return. If the venous valves are intact, venous back pressure on the capillary bed in the extremity is reduced to zero, thereby improving the arterial-venous gradient. Both of these actions may increase volume return to the heart, and neither is dependent upon timing the leg compression with the end-diastolic portion of the heartbeat.

End-diastolic intermittent pressure to an extremity provides several additional advantages, however. The first is the promotion of arterial flow in an ischemic extremity, such as a leg. The blood pulse wave is allowed to enter the leg, and compression provides a driving force to disseminate the blood through the tissues. Moreover, timing of compression with the end-diastolic portion of the heart cycle tends to augment the wave form that is reflected back from the compressed extremity. In a resting patient, the normal pulse wave that enters a leg, for example, wells up and is reflected backward toward the heart. Properly timed end-diastolic pumping applies pressure in addition to the normal pulse waves in the leg, which both disseminates blood in the leg and augments the reflected wave form. This augmentation of the reflected wave form can increase splanchnic, renal and coronary flow.

Properly timed end-diastolic pressure also has the potential of promoting aortic pulse wave harmonics. Decompressing the extremity in the presystolic phase of the heart cycle functions to drop the pressure in the inflatable enclosure, thereby creating a negative pressure gradient that effectively augments the reflected wave form from the aortic valve in presystole and decreases cardiac afterload. The diastolic timing of the compressions and their release in presystole thus augments normal pressure waves and allows the compression device to effectively operate at comfortable pressures, such as 45–70 mm Hg. Thus, end-diastolic intermittent pressure on an extremity has several positive effects on cardiac function. First, in preload phase, the blood returning to the heart from the peripheral circulation has a greater momentum, thereby enabling more efficient loading of the heart without as much work. Second, the decrease in afterload allows more complete emptying of the heart, thereby allowing the ejection fraction and cardiac output to increase.

Intermittent external pressure on the extremity, when timed to the end-diastolic portion of the heart cycle has significant positive clinical effects. For example, patients may be relieved of heart failure. Their pulmonary edema may be relieved and their serum lactate/pyruvate ratio reduced. Those patients with a murmur due to insufficiency of the mitral valve are found to have a decrease in the intensity of their murmur as more blood enters the aorta and legs, and is returned to the left atrium. Urinary output commonly increases in patients with prerenal azotemia. An increase in cardiac output per heartbeat is associated with a reflex slowing of the pulse rate in both sick and normal patients.

The observed effect of rescuing patients from acute myocardial infarction has been hypothesized to result from several factors. First, as described earlier, the work of the heart and its oxygen requirements are decreased when properly-timed intermittent compression of an extremity is applied. The observed increased ejection fraction of the heart probably signifies that stunned heart muscle is again contracting, thereby resuming the work of pumping blood. Additionally, intermittent compression of an extremity stimulates the formation of fibrinolysins in the blood, which may aid in dissolving coronary clots. Thus, the augmentation of preload and decrease in afterload can normalize muscle contractions, mechanically moving and possibly squeezing the coronary arteries. This action, together with the stimulation of fibrinolysins, can help restore patency to coronary arteries blocked with thrombus.

To this end, U.S. Pat. Nos. 3,961,625, 4,269,175, 4,343,362 and 4,590,925 to the present inventor disclose methods and apparatus to provide end-diastolic intermittent pressure to one or more extremities. The above-referenced patents emphasize a unique timing that relates compressions of the extremity to the occurrence of the QRS complex in the EKG tracing, which represents electrical systole for the ventricles.

With respect to timing compression of the extremity to promote blood flow through the extremity, the time delay from the QRS complex to the entry of the blood pulse into the extremity must be taken into account. The application of pressure is typically set at a pre-determined variable interval after the QRS complex, and the release of pressure may be set at a pre-determined variable interval after application of the pressure, or it may be triggered by the next QRS complex.

The timing of application of pressure depends on the pulse rate of the patient and on the size of the extremity. Compression is preferably applied as late as possible in the diastolic portion of the heart cycle. However, because the pressure in the air bag must overcome the inertia of blood in the extremity, the time of inflation of the air bag must be sufficiently long to overcome this inertia. For circulation-promoting systems such as that described in U.S. Pat. No. 4,343,302, a compression time of no less than 0.34 seconds is necessary.

Thus, an intermittent external compression system, in order to provide effective promotion of circulation through an extremity, is regulated by a timing cycle comprising a time delay (time from the pulse generated at the QRS complex to reach the extremity) and a compression period (time which the extremity is compressed to facilitate movement of the blood through the extremity). The compression period should be calculated and set on the basis of the size of the extremity, and the time delay should compensate for movement of the pulse from the heart to the extremity. Current systems accomplish this either by pre-setting the time delay and the compression period, so that the sum of the two is approximately equal to the time between QRS complexes, or by manually adjusting the time delay to take into account changes in heart rate. Neither of these current methods is adequate to assure effective pumping of blood through the extremities of patients having either a very rapid and/or an irregular heart rate, nor can they compensate for the normal slowing of the heart rate that accompanies intermittent pressure therapy. Currently, no method is available for adjusting the timing cycle to better coincide with QRS complexes of patients with variable heart rates. Clearly, in order for external intermittent pressure therapy to be fully effective in such cases, such a method is needed.

With respect to promoting the flow of blood through the heart, the timing of pressure and release on the extremity again is important. The first fraction of mechanical systole is an isometric contraction in which the muscle tightens around the contained blood, raising the pressure within the ventricle from a low level to the level of diastolic blood pressure. When the intraventricular pressure reaches diastolic blood pressure, the aortic valve opens and blood begins to leave the ventricle, as the ventricular chamber actually decreases in size. Electrical systole, hence, precedes the first movement of blood from the ventricles by approximately 0.05 seconds. Peak ventricular outflow occurs approximately 0.1 seconds later, or 0.15 seconds after the QRS complex occurs. Blood ejection from the ventricles ends with the closure of the aortic valve, which follows the QRS complex by about 0.24 seconds. Assuming that pulse waves from the extremity to the heart travel at approximately 20–40 feet per second (the rate at which they would travel in water, a noncompressible medium), the drop in pressure caused by release of compression on the extremity is perceived by the heart within approximately 0.1–0.15 seconds. In view of the fact that blood ejection from the ventricles takes approximately 0.24 seconds after the QRS complex, if the extremity is decompressed at the next QRS complex, and 0.1–0.15 seconds pass before the drop in pressure is perceived by the heart, the drop in aortic blood pressure due to the release of the extremity is perceived by the heart for perhaps only the last $\frac{3}{4}$ of the systole. To facilitate complete unloading of the heart, however, it would be preferable if pressure to the extremity were released approximately 0.1–0.15 seconds before the next occurring QRS complex, so that the drop in pressure perceived by the heart occurs for the entire duration of systole. This could be accomplished by triggering the decompression of the air bag either by the "P" wave (atrial systole), or by manually anticipating occurrence of the next QRS complex and triggering deflation of the air bag approximately 0.1 seconds earlier. The use of the "P" wave is limited to those patients having "P" waves. Patients with atrial fibrillation have no "P" waves.

Thus, promotion of blood circulation through the heart involves precise timing of decompression of the extremity to occur shortly (e.g., 0.1 seconds) before the next occurring QRS complex. Manual adjustment of the time delay, which is the method currently available to regulate compression and decompression with the QRS complex, is clearly a cumbersome and inadequate means to precisely control decompression of the extremity to enable complete unloading of the heart. Patients with rapid or irregular heart rates are particularly disadvantaged because it is extremely difficult to continuously adjust compression and decompression of the extremity to coincide with a particular instant in the QRS cycle. In promoting pumping of blood through the heart and through an extremity, then, a method of adjusting compression and decompression of the air bag would indeed be a marked improvement over the methods currently available.

SUMMARY OF THE INVENTION

In accordance with the present invention, a method is provided for promoting the circulation of blood through a patient's extremity. In one aspect of the invention an inflatable enclosure, such as an air bag, is applied to an extremity (e.g., leg), so that upon inflation and deflation of the air bag, the extremity is alternately compressed and decompressed. Compression and decompression of the extremity is regulated by sensing the QRS complex in the heart cycle of the patient, computing an average time period between a selected number of successive QRS complexes, and initiating a timing cycle for compressing and decompressing the extremity.

The timing cycle is based on the average time period between sensed QRS complexes. The timing cycle is comprised of an adjustable time delay and a compression period, and is initiated at the occurrence of a QRS complex. The air bag is inflated at the conclusion of the time delay following the initiation of the timing cycle, thereby compressing the extremity. Inflation is maintained over the compression period; then the air bag is vented to initiate deflation at the conclusion of the compression period.

The duration of the time delay and the compression period are controlled relative to the average time period between QRS complexes, so as to avoid inflating the air bag during the occurrence of a QRS complex. This method offers the notable advantage of coinciding the release of pressure on the extremity with the QRS complex, so that the wave form generated by the heart may enter the extremity unobstructed. Since the timing cycle is adjustable, being based on a selected number of prior successive QRS complexes, compression on the extremity is released before the next QRS complex even if the pulse rate changes. Thus, even patients having an irregular heart rate may benefit from this method of promoting circulation of blood.

According to another aspect of the invention, instead of adjusting the timing cycle so that the compression period ends at the occurrence of the next QRS complex, the timing cycle is set so that the compression period ends shortly, e.g. 0.1 seconds, prior to the occurrence of the next QRS complex. This adjustment confers the additional benefit of promoting blood flow through the heart, as well as through the extremity, by allowing the drop in pressure in the extremity to reach the base of the heart, thereby enabling complete blood ejection from the ventricles. If decompression is not effected until the actual occurrence of the next QRS complex, even though blood flow is promoted through the extremity, optimum flow of blood through the heart is not accomplished.

BRIEF DESCRIPTION OF THE DRAWINGS

The foregoing summary, as well as the following description of preferred embodiments of the present invention, will be better understood when read in conjunction with the appended drawings in which:

FIG. 1 is a diagramatic representation of an intermittent compression apparatus having controls for performing the method of the present invention;

FIG. 2 is a typical EKG tracing of a normal heart rate;

FIG. 3 is a diagram relating certain circulation events in the heart to action of the intermittent compression apparatus, as controlled by the method of the present invention;

DETAILED DESCRIPTION OF THE INVENTION

Referring to the drawings and initially to FIG. 1, a system for promoting the circulation of blood through a patient's heart and extremity is illustrated. For this treatment, the circulation of blood is artifically enhanced by the compression and decompression of the extremity through the controlled application and removal of pressure on the extremity. For this purpose, an inflatable enclosure or air bag shown diagrammatically at 10 is provided for covering at least a portion of the patient's extremity to be treated. The inflatable enclosure is then inflated and deflated to apply controlled external pressure on the extremity.

Where a patient's leg is to be treated, for example, the inflatable enclosure, as diagrammatically illustrated in FIG. 1 is in the form of an inflatable legging or boot 10.

The legging 10 is inflated and deflated with inflating fluid, preferably compressed air or other gas, which is introduced to and removed from the enclosure through a fluid access port 22, and exhaust outlet 24.

A fluid control system 20 functions to supply and exhaust compressed gas from a source 26 to and from the inflatable legging in order to compress and decompress the patient's leg to promote circulation of blood. The timing of compression and decompression of the leg by the fluid control system is controlled by a pulse monitor 13 so that compression and decompression of the patient's leg is phased to the patient's heartbeat. To accomplish this, the pulse monitor comprises a sensing device, such as an electrocardiograph (EKG) 14, for monitoring the patient's heartbeat, a computer 12 and a timer 16.

To precisely synchronize compression and decompression of the patient's leg to the patient's heartbeat, the sensor senses several successive QRS complexes in the patient's heart rate, and an average time period between successive QRS complexes is calculated by the computer. FIG. 3 illustrates at D a typical heart cycle of 0.65 seconds from an EKG display of a heart rate of 92 beats per minute. The average time period between QRS complexes is recalculated upon the occurrence of each next QRS complex, thereby allowing adjustment for irregularities in the heart rate. Based on the computed average time period, a timing cycle is initiated by the timer 16, at the occurrence of the next QRS complex. The timing cycle comprises an adjustable time delay and a compression period followed by a decompression period. The timing of the fluid control device is diagrammed at B in FIG. 3. As shown, an adjustable time delay 32 is provided to allow the pulse of blood to travel from the heart to the leg. During the time delay, the exhaust outlet 24 of the fluid control system remains operable to divert pressurized gas away from the inflatable legging.

At the conclusion of the time delay period 32, the exhaust outlet is closed and the fluid inlet 22 is activated to supply pressurized air or other fluid to the inflatable legging to pressurize the enclosure as indicated at 34. The inflatable enclosure remains pressurized for the duration of the compression period 34, when it is then triggered by the timer 16 to decompress as indicated at 36, at which time the fluid inlet 22 is closed and the exhaust outlet 24 is opened to deflate the inflatable legging. The time delay is adjusted such that the time delay 32 and the compression period 34 together do not exceed the average time period between QRS complexes, thereby avoiding compression of the leg during the next occurring QRS complex. This adjustment enables decompression of the extremity slightly before the projected occurrence of the next QRS complex, which, as described earlier, promotes circulation of blood through the heart, as well as through the extremity. In this manner, compression of the leg forces the flow of blood into the leg while not obstructing the natural blood pulses to the leg. To facilitate blood flow to the heart, the time delay 32 is adjusted so that the sum of the time delay 32 and the compression period 34 is about 0.1 seconds less than the average time period. As described in greater detail below, decompressing the leg for the period 36 in advance of the next QRS complex promotes emptying of the left ventricle, thereby decreasing the workload of the heart.

Referring to FIG. 2, a preferred embodiment of the present invention involves sensing the patient's heartbeats by electrocardiograph. FIG. 2 illustrates a typical EKG tracing, which can be utilized in the present invention to measure successive occurring QRS complexes, and to compute an average time period between said complexes. FIG. 2 illustrates the major deflection from the baseline in an EKG tracing, as described in greater detail below.

According to the present invention, a method is provided for promoting the circulation of blood through a patient's heart and selected extremity or extremities. The method involves precise timing of externally applied intermittent pressure, and release thereof, to a patient's extremity, in such a way as to reinforce the natural pulses of blood to the extremity, thereby facilitating circulation through the extremity and decreasing the work of the heart.

FIG. 3 at A displays the timing and pressure events in the heart cycle. The EKG tracing at D is labelled to indicate deflections from the baseline: "P" indicates atrial systole; "Q" (downward), "R" (upward) and "S" (downward), together comprise the "QRS" complex. The "T" represents ventricular repolarization or recovery. The QRS complex represents electrical systole for the ventricles. Mechanical systole, actual contraction of the heart muscle, occurs a few hundredths of a second later, as can be seen by the increase in pressure in the heart organ, displayed at A. Line 42 represents the pressure in the aorta, line 44 the pressure in the left ventricle, line 46 the pressure in the pulmonary artery, line 48 the pressure in the left atrium, line 50 the pressure in the right atrium and line 52 the pressure in the right ventricle. The aortic valve opens at 54 and closes at 56. The corresponding change in blood volume is diagramed at C in FIG. 3 in which line 60 represents the blood volume in the left ventricle and line 62 represents the blood volume in the right ventricle. Thus, the first fraction of mechanical systole between 0 and 54 is an isometric contraction in which the muscle tightens around the contained blood, raising the pressure within the left ventricle from a low level to the level of diastolic blood pressure. When the intraventricular pressure reaches diastolic blood pressure, the aortic valve opens and blood begins to leave the ventricle. As can be seen at C, the opening of the aortic valve is followed by a decrease in blood volume in the left ventricle.

Cardiac output may be increased by enhancing the emptying of the ventricle during systole. According to the method of the invention, this may be accomplished by timing the release of compression on the extremity such that the drop in pressure is perceived by the heart during the entire time of the systole. Because of the time needed for a change in pressure to move from the extremity to the heart, if the pressure in the extremity is not released until the next QRS complex, the drop in pressure is perceived by the heart only during approximately the last ¾ of systole. In order for the drop in pressure to be perceived by the heart for the entire duration of systole, it is necessary to trigger decompression of the extremity shortly, e.g. 0.1 seconds, before the next occurring QRS complex. According to a preferred embodiment of the present invention, decompression of the extremity at 36 is triggered by the computer device 12, programmed to anticipate the occurrence of the QRS complex, and trigger deflation of the air bag approximately 0.1 seconds earlier than the QRS complex. According to the present invention, the occurrence of each QRS complex is projected by measuring the time between several successive previous QRS complexes, and computing an average time interval. Thereafter, the computer device adjusts the time delay 32 between the last QRS complex and inflation of the air bag, and adjusts the compression period 34 to trigger deflation of the bag approximately 0.1 seconds before the next projected QRS complex occurs.

Intermittent external compression therapy is designed to help the general circulation, but especially the arterial circulation in extremities, e.g., legs. For example, to aid in circulation to legs, compression on the leg should be released with the QRS complex so that the wave form generated by the heart may enter the legs unobstructed. Because the early part of the wave form reaches about 0.15 seconds after the QRS complex, unobstructed flow is accomplished whether the legs are decompressed with the QRS complex or 0.1 seconds before the complex. The extremity should never be released after the QRS complex. Thus, the timing of the delay 32 and the compression 34 of the legs, are preferably adjusted to maximize both cardiac output and circulation to the extremity by timing the release of pressure on the extremity to approximately 0.1 seconds before the next QRS complex. In any event, the decompression period 36 should be in the range of 0 to 0.2 seconds before the next timing cycle.

The method of the invention may be used in connection with intermittent external compression devices, such as those disclosed in U.S. Pat. Nos. 3,961,625, 4,269,175, 4,343,302 and 4,590,925, all to the present inventor. Those devices utilize air-inflatable enclosures, which are preferable for use with the method of the present invention. The method is preferably implemented through the use of a pulse monitor having a computer device. The monitor senses the QRS complex in the patient's heart cycle. The computer measures the time interval between a selected number of successive QRS complexes (e.g., 3), then computes an average time interval based on the measurement of the successive QRS complexes.

Any change in heart rate will necessitate a change in the monitor settings if the compression of the extremity is to precede and end with (or shortly before) each QRS complex. The average time period between QRS complexes is divided into a pre-determined time delay 32 and a compression period 34, the sum of which should be equal to the average time period (or the average time period minus 0.1 seconds, in the preferred embodiment leaving a terminal decompression period 36). In using the method of the invention with any of the compression devices disclosed in the patents enumerated above, the compression period must be set for a long enough time to achieve good compression within the device enclosing the extremity. The larger the air bag (or the larger the patient), the longer the time needed for the air bag to inflate to the desired pressure. This compression period should preferably range from between about 0.34 to about 0.5 seconds, and should be adjusted and set in consideration of the size of the air bag and of the extremity to be enclosed.

Once the compression period is set, the time delay between the QRS complex and when inflation of the boot is initiated must be adjustable so that the sum of the time delay 32 and the compression period 34 is equal to the average time period described above. In practice of the present invention, the time delay is automatically adjusted, depending on the average time period calculated for the prior successive QRS complexes. For example, suppose a series of three successive heartbeats occur such that the intervals between the successive QRS complexes are: 0.9 seconds, 1.1 seconds and 1.0 seconds. The average time period calculated by the computer would then be 1.0 seconds for the next immediate timing cycle. Suppose, in addition, that the extremity to be treated is the lower portion of a patient's leg, and that the size of the air bag is relatively small, thereby indicating a compression period of approximately 0.34 seconds. Thus, the time delay 32 between the QRS complex and the initiation of inflation of the air bag will automatically be adjusted to equal 0.66 seconds, which is the difference between the average time period (1.0 seconds) and the compression period 34 (0.34 seconds). In a preferred embodiment, however, deflation is triggered approximately 0.1 seconds before the next succeeding QRS complex to initiate a decompression period 36. In this case then, the time delay 32 is automatically adjusted to 0.56 seconds, which is the duration of the average time period minus the decompression period 36 (0.10 seconds) and the compression period 34 (0.34 seconds).

The next timing cycle follows the same format, except that it calculates the average time period from the three most recent previous QRS complexes. Extending the above example, if the time interval for the next QRS complex is again 1.0 seconds, then the computer would average 1.1 seconds, 1.0 seconds and 1.0 seconds, arriving at a new average time period of 1.033 seconds.

Because the method of the invention calls for adjusting the pre-determined time delay on the basis of immediately previous QRS complexes, the timing cycles are much more precisely aligned to the patient's actual heart rate than if the pre-determined time delay were not adjustable. Moreover, automatic adjustment of the pre-determined time delay by a computer is greatly preferable to a system involving manual adjustment of the time delay, which requires constant attention by a technician and is subject to human error. The compression period is selected to promote optimum pumping of blood through the extremity and heart, and depends upon the size of the extremity. Once selected, the compression period may remain fixed, while the delay time is adjustable, as described above.

The method is particularly advantageous for two reasons. First, patients having various heart diseases and conditions often have irregular heart rates. The method of the invention decreases the problematic effects of an irregular heart rate and enables such patients to benefit from intermittent external compression therapy. Second, the beneficial effects of intermittent compression therapy on cardiac output often reflexively slows the heart rate. The method of the invention is capable of taking the slowing into account.

Intermittent external compression therapy is difficult in patients whose pulse rates are faster than 120 beats per minute, since there is only 0.5 seconds or less between QRS complexes. To obtain adequate pressure on the extremity requires approximately 0.34–0.50 seconds, leaving 0–0.16 seconds for a time delay, which may be insufficient to avoid interference with the natural blood pulses to the extremity. The compression period is set to allow for adequate pressurization in the air bag so a short delay time must chosen so that the sum of the delay time and the compression period equals the time between QRS complexes.

According to another aspect of the present invention, instead of emptying the heart on every QRS complex, the monitor can be set to empty the heart on every second or third QRS complex. For example, for a pulse rate of 140, the monitor may be set to facilitate ventricular emptying every other heartbeat, resulting in maximizing systolic emptying of the heart 70 times a minute. To accomplish this, the compression period is set to provide adequate pressurization of the air bag, and the time delay is adjusted so that the timing cycle encompasses two QRS cycles, rather than one. In the case of very rapid heart rates, the time delay may be adjusted to allow for three successive QRS complexes. Thus, compression of the extremity may be adjusted to occur after every heartbeat, every second heartbeat or every third heartbeat. In a preferred embodiment, the computer in the monitor may shift from 1:1 to 2:1 or 3:1 automatically, depending on the heart rate of the patient. As noted previously, to maximize the unloading of the ventricle during all of systole, depressurization of the air bag is adjusted to provide a decompression period approximately 0.1 seconds before the occurrence of the next QRS complex.

In this embodiment, the time delay 32 is adjusted so that the sum of the time delay 32 and the compression period 34 is an integral multiple of the average time period between complexes, which enables compression of the extremity to occur less often than with every QRS complex, while still avoiding inflation of the air bag during occurrence of a QRS complex. Patients having rapid heart rate may thereby benefit from the method of the invention, even though their heart rate is too rapid to allow a suitable time delay and compression period to occur with each QRS complex.

As mentioned previously, the method of the invention is preferably embodied in a pulse monitor, which controls a fluid control system. The fluid control system functions to supply and exhaust compressed gas (e.g., air) to and from the inflatable enclosures, thereby to compress and decompress the patient's extremities. Such a pulse monitor may be used on any fluid control system, but it is preferable to use the system disclosed and claimed in my prior U.S. Pat. No. 4,590,925 issued on May 27, 1986. The system uses a pulse monitor to control the fluid control system so that compression and decompression of the patient's extremity is synchronized to the patient's heartbeat. As shown in FIG. 3, during the time delay 32, an exhaust outlet 24 of the fluid control system remains open to vent pressurized gas from the inflatable air bag 10. At the conclusion of the time delay, the exhaust outlet is closed and an air inlet is opened to supply pressurized air to the inflatable bag for the compression period 34. The bag remains pressurized until triggered to initiate the decompression period 36, according to the timing described above. To ensure that the patient's extremity is not subjected to extreme pressure and that the air bag is not inflated during a QRS complex, several safety features are incorporated into the adjustable pulse monitor. For example, the monitor may be set so that an early QRS complex automatically interrupts compression of the air bag and signals deflation, thus prohibiting inflation of the air bag during cardiac systole. Likewise, the monitor may be set with a mechanism to interrupt inflation of the air bag, should a designated peak pressure be exceeded. In a preferred embodiment, the monitor and fluid control system are adjusted so that inflation of the air bag will not be allowed if the pressure within the air bag does not return to a pre-set baseline level, or a selected value near baseline.

The method of the invention is preferably embodied in a pulse monitor attached to a visual display screen. Information related to the control and operation of the intermittent pressure therapy may be displayed on the screen. Such information may include: (1) the EKG tracing showing the occurrence and shape of the QRS complex; (2) the duration of each adjustable time delay; (3) the duration of the compression period; (4) the pressure of the air bag being applied to the patient's extremity; (5) brachial systolic and diastolic blood pressure; (6) changes in the blood flow in the skin of the extremity being compressed, which can be measured by a photoelectric plethysmographic (PPG) electrode and/or transcutaneous $p0_2$ electrode; (7) changes in the blood flow to a non-compressed extremity (e.g., finger) to reflect systemic blood flow, also measurable by PPG and/or transcutaneous $p0_2$ electrode; and (8) pulse volume values to measure blood flow in a compressed or non-compressed extremity, wherein the latter would reflect the overall blood flow in the body.

The methods and devices of the present invention offer several advantages over methods presently available for promoting the flow of blood through an extremity. Most notably, the timing of compression and decompression of the extremity can closely correlated with the natural flow of blood accompanying each heartbeat. This is accomplished by tying the inflation and deflation of the air bag with the occurrence of a QRS complex, said complex signaling the electrical systole of the heart cycle. By adjustably timing the deflation of the air bag to occur with, or slightly before, the next QRS complex, the blood pulse is able to enter the extremity freely, without being blocked by outflow of the previous pulse. This enables optimum promotion of blood flow with the application of relatively low pressure (e.g., 50–70 mm mercury to the extremity). Because the time delay is adjusted automatically, on the basis of a selected number of previous successive QRS time intervals, even patients with irregular or rapid heart rates can be treated by this method. Moreover, adjusting the timing cycle so that compression to the extremity is released 0.1 seconds prior to the occurrence of the next QRS complex introduces the additional advantage of promoting optimum circulation of blood, not only through the extremity, but through the heart as well. The precise timing required to effect such optimal blood flow was heretofore unavailable, as current methods rely on non-adjustable or manually-adjustable timing cycles. Thus, the methods of the present invention represent a significant advance over methods previously employed.

While certain preferred embodiments of the present invention have been illustrated and described, the present invention is not limited to these embodiments. For example, the methods of the present invention may be applied to external intermittent compression devices which do not comprise an inflatable air bag. For example, pressurization by means of other fluids, such as water, have been disclosed. The methods of the invention may be utilized in connection with such devices. Other modifications may be apparent to one skilled in the art within the scope of the following claims.

What is claimed is:

1. A method for promoting circulation of blood through a patient's heart and extremity comprising the steps of:

a) applying an inflatable enclosure to the extremity, so that upon inflation and deflation of the enclosure, the extremity is alternately compressed and decompressed;

b) sensing a QRS complex in a heart cycle of the patient and computing an average time period between a selected number of successive sensed QRS complexes in successive heart cycles of the patient;

c) initiating a timing cycle for compressing and decompressing said extremity, said timing cycle being comprised of an adjustable time delay, a compression period and a decompression period, said timing cycle being calculated relative to said average time period, said timing cycle being initiated at a QRS complex following said selected number of successive sensed QRS complexes;

d) inflating the inflatable enclosure at the end of said time delay following the initiation of said timing cycle, thereby effecting compression of the extremity at the conclusion of the time delay;

e) maintaining said inflation of the inflatable enclosure over said compression period and deflating the inflatable enclosure to initiate said decompression period after said compression period; and f) controlling said timing cycle relative to said average time period so as to initiate said decompression period sufficiently late in said heart cycle to facilitate both entry of a QRS-associated pulse wave into said extremity and ventricular ejection of blood from said heart, but before a next occurring QRS complex, thereby promoting circulation of blood through said heart and said extremity of the patient.

2. A method according to claim 1, wherein said decompression period is less than 0.2 seconds.

3. A method according to claim 1, wherein said time delay is adjusted so that said timing cycle is an integral multiple of said average time period, thereby enabling compression of said extremity to occur with less frequency than with every QRS complex, while avoiding inflation of said inflatable enclosure during occurrence of a QRS complex.

4. A method according to claim 1, wherein said time delay is selected to accommodate a travel time of a QRS-associated pulse wave from the heart to the extremity.

5. A method according to claim 1, wherein said average time period is computed by averaging time periods between three successive QRS complexes immediately prior to the QRS complex initiating said timing cycle.

6. A method according to claim 1, wherein information relating to said controlling is displayed on a screen, said information being selected from the group consisting of:

a) shape of said QRS complex;

b) duration of said time delay;

c) duration of said compression period;

d) pressure of said inflatable enclosure on said extremity;

e) brachial systolic and diastolic blood pressure;

f) changes occurring in blood flow in the skin of said extremity;

g) changes occurring in blood flow of skin other than that of said extremity; and h) a combination of any or all of (a)–(g).

7. A method according to claim 1, which further includes interrupting said timing cycle in the event that a QRS complex is sensed during the compression period of said timing cycle, said interruption causing deflation of said inflatable enclosure, thereby terminating the compression period.

8. A method according to claim 1, wherein said timing cycle is re-calculated after each successive QRS complex.

9. A method according to claim 1, wherein said decompression period is initiated during the last third of said average time period.

* * * * *